United States Patent [19]

Rossi

[11] Patent Number: 4,514,314

[45] Date of Patent: Apr. 30, 1985

[54] OIL SOLUBLE ESTER POUR POINT DEPRESSANT ADDITIVE FOR LUBRICANTS

[75] Inventor: Albert Rossi, Warren, N.J.

[73] Assignee: Exxon Research and Engineering Co., Florham Park, N.J.

[21] Appl. No.: 565,161

[22] Filed: Dec. 23, 1983

Related U.S. Application Data

[63] Continuation of Ser. No. 269,754, Jun. 2, 1981, abandoned, which is a continuation-in-part of Ser. No. 98,626, Nov. 29, 1979, abandoned.

[51] Int. Cl.[3] ..... C10M 1/28

[52] U.S. Cl. ..... 252/56 D

[58] Field of Search ..... 252/56 D, 56 R

[56] References Cited

U.S. PATENT DOCUMENTS

| | | | |
|---|---|---|---|
| 2,655,479 | 10/1953 | Munday et al. | 252/56 R |
| 2,666,746 | 1/1954 | Munday et al. | 252/56 D |
| 2,721,877 | 10/1955 | Popkin et al. | 252/56 D X |
| 3,729,296 | 4/1973 | Miller | 252/56 D X |
| 3,765,849 | 10/1973 | Ilnyckyj et al. | 252/56 D X |
| 4,151,069 | 4/1979 | Rossi | 252/56 D X |

FOREIGN PATENT DOCUMENTS

| | | | |
|---|---|---|---|
| 1245879 | 9/1971 | United Kingdom | 252/56 D |

*Primary Examiner*—Andrew Metz

*Attorney, Agent, or Firm*—Frank T. Johmann

[57] ABSTRACT

An oil soluble copolymer, useful as a pour point depressant for lubricating oils, is a $C_{22}$–$C_{40}$, preferably $C_{32}$–$C_{36}$, branched alkyl ester based polymer. These alkyl esters of copolymers are essentially free of olefinic unsaturation and have a number average molecular weight of from 1,000 to 40,000, preferably 2,000 to 15,000, optimally 2,000 to 8,000.

These alkyl ester copolymers are usefully admixed with lubricants in an amount of from 0.01 to 2 wt. % based on the total weight of the admixture and are of the class consisting of a $C_{22}$–$C_{40}$ branched alkyl ester of a copolymer of a $C_2$ to $C_{20}$ 1-olefin and maleic anhydride and di-(2-[$C_{22}$ to $C_{40}$] alkyl) fumarate-vinyl $C_1$–$C_4$ alkylate e.g. acetate copolymer.

3 Claims, No Drawings

OIL SOLUBLE ESTER POUR POINT DEPRESSANT ADDITIVE FOR LUBRICANTS

CROSS-REFERENCE TO RELATED APPLICATIONS

This is a continuation of application Ser. No. 269,754, filed June 2, 1981 which is a continuation-in-part of Ser. No. 98,626, filed Nov. 29, 1979 both now abandoned.

BACKGROUND OF THE INVENTION

1. Field of the Invention

This invention relates to a lubricating oil additive and lubricating oils incorporating a minor proportion of said additive to depress the pour point of said oil.

The additive is a $C_{22}$–$C_{40}$ branched alkyl ester based copolymer derived from an ethylenically unsaturated dicarboxylic acid material.

2. Prior Art

A wide variety of compositions comprising polymeric materials derived from the addition reaction of 1-olefins and ethylenically unsaturated carboxylic acid materials have been described in the literature as additives for fuels and lubricants. For example: U.S. Pat. No. 2,615,845 teaches that the copolymer of maleic anhydride and a straight chain 1-olefin having up to 20 carbon atoms which is subsequently esterified with long, straight chain, saturated alcohols in order to make it suitably oil-soluble can be usefully added to a mineral lubricating oil for pour point depression; and U.S. Pat. No. 2,655,479 points out that a factor of particularly great effect on the pour depressant activity of acrylic ester polymers is the length of the alkyl side chains (apparently a function of the oil solubilizing effect of the alkyl side chain) except that polymers of single esters are rarely pour point depressants; and U.S. Pat. No. 2,509,203 teaches of a pour depressant for lube oils being composed of a polymer of a di-($C_{10}$ to $C_{16}$ alkyl)-fumarate.

It is also known to use ester based copolymers for various other applications relating to the processing and/or utilization of petroleum products, e.g.: U.S. Pat. No. 3,449,236 teaches as a dewaxing aid, a copolymer of $C_6$ to $C_{28}$ diolefin with maleic anhydride which is then esterified or amidated with a $C_{12}$ to $C_{30}$ alcohol or amine; U.S. Pat. No. 4,151,069 teaches that olefin maleic anhydride copolymers esterified with $C_{18}$ to $C_{50}$ linear alkyl side chains are filtration aids for dewaxing of waxy lubricating oils; and copolymers of $C_{20+}$ olefins with maleic anhydride with $C_{20+}$ alcohols have been taught as fluidity improvers in various types of liquid hydrocarbons boiling from about 75° F. to about 1,000° F., including distillates, crudes and residual oils, in Dutch Application No. 69/13277.

SUMMARY OF THE INVENTION

In contrast to the teachings of the various prior art references described above, it has been discovered that branched alkyl, pendant chains having from 22 to 40, preferably 32–36, carbons when derived from the esterification of an ester base copolymer obtained from ethylenically unsaturated dicarboxylic acid material provides highly useful pour point depressant activity in lubricating oils, said copolymer having a number average molecular weight ($\overline{M}_n$) of from 1,500 to 40,000 preferably 2,000 to 15,000, optimally 2,000 to 8,000.

These oil-soluble ester base copolymers are useful as pour point depressants when compounded in lubricating oils in at least a pour point depressing amount preferably to 0.01 to 1.0 wt. %, optimally 0.05 to 0.3 wt. % based on the total composition, and are preferably produced by the polymerization of: (a) 1-olefin of from 2 to 20, optimally 14 to 18, carbons and maleic anhydride followed by the reaction of said copolymer with from 1.2 to 2.0 moles of a $C_{22}$ to $C_{40}$, e.g. $C_{24}$ to $C_{40}$, optimally $C_{32}$ to $C_{36}$, branched alcohol per mole of maleic anhydride moiety in said copolymer or (b) a di-($C_{22}$ to $C_{40}$, e.g. $C_{24}$ to $C_{40}$ preferably $C_{32}$ to $C_{36}$ branched alkyl) fumarate and vinyl acetate.

DESCRIPTION OF THE PREFERRED EMBODIMENTS

The ester base copolymer found to be the highly advantageous pour point depressants for lubricating oils are characterized by polymers having long chain branched alkyl pendant groups positioned along the backbone of the polymer. These ester base copolymers are of the class consisting of (a) $C_{22}$ to $C_{40}$ branched alkyl esters of the copolymer of a $C_2$ to $C_{20}$ 1-olefin and an ethylenically unsaturated dicarboxylic acid material and (b) di-($C_{22}$ to $C_{40}$ branched alkyl)fumarate-vinyl $C_1$–$C_4$ ester, preferably vinyl acetate.

The ethylenically unsaturated dicarboxylic acid material is intended to include the acid, anhydride and lower alkyl, i.e., $C_{1-C4}$ esters. Preferably these copolymers are derived from the ethylenically unsaturated dicarboxylic anhydride such as maleic and itaconic, e.g. an addition polymer of a $C_{18}$ 1-olefin and maleic anhydride.

The addition reaction between the dicarboxylic acid, anhydride or ester and 1-olefin having from 1 to 20 carbons can conveniently be carried out by mixing the 1-olefin with an equimolar amount of anhydride or derivative and heating the mixture to a temperature of from about 50° C. to about 155° C., preferably from 80° C. to 120° C. A free radical polymerization promoter such as t-butyl hydroperoxide, azoisobutyl nitrile, benzoyl peroxide, t-butylperbenzoate or di-t-butyl peroxide is normally used. The resulting addition polymeric product has a number average molecular weight ($\overline{M}_n$) of about 1,000 to 30,000, more usually 1,500 to 20,000 and suitably about 2,000 to 10,000.

The addition product thus prepared is reacted with about 2 moles per mole of dicarboxylic acid material of a branched alcohol containing from 22 to 40, preferably 24 to 36, optimally 32 to 36, carbon atoms per molecule. Reaction is readily carried out by heating at from 50° to 150° C. until all of the water of esterification is removed. A catalyst may be used to accelerate the esterification. Suiable catalysts are methane sulfonic acid and p-toluene sulfonic acid.

The dialkyl fumarate-vinyl ester addition copolymer is readily produced by esterification of fumaric acid or fumaryl chloride with the $C_{22}$ to $C_{40}$ branched, preferably 2-$C_{22}$ to $C_{40}$, alkanols to yield a di-ester which is thereafter polymerized with a vinyl $C_1$–$C_4$ ester, preferably vinyl acetate by techniques well-known in the art and are usually made by free radical initiation, e.g. a peroxide, in a solvent.

2-alkyl alkanols useful in preparing the above types of polymers include those having 10 to 18 carbons in the alkyl portion and 12 to 22 carbons in the alkanol portion. Such alcohols include 2-decyl dodecanol, 2-decyl tetradecanol, 2-dodecyl dodecanol, 2-dodecyl tetradecanol, 2-tetradecyl hexadecanol, 2-tetradecyl octadecanol, 2-hexadecyl octadecanol and mixtures thereof.

Particularly preferred are 2-alkyl alkanols wherein the alkyl portion contains 10 to 18 carbons and the alkanol portion contains 12 to 22 carbons, which include those of the formula:

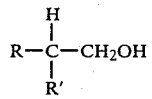

where R is a straight chain alkyl group of 10 to 18 carbons and R′ is a straight chain alkyl group of 12 to 20 carbons, preferably R is 14 to 16 carbons and R′ is 16 to 18 carbons. Alcohols of this formula are commercially available from Henkel, Inc. where R′ is 2 carbons greater than R, under tradenames Standamul GT-2428 where R is 10 and 12, while R′ is 12 and 14; and Standamul GT-3236 where R is 14 and 16 while R′ is 16 and 18.

The oil-soluble ester based copolymeric additives can be incorporated in lubricating oil compositions, e.g. automotive crankcase lubricating oils, in concentrations within the range of about 0.01 to 2.0 wt. %, preferably 0.01 to 1.0, optimally 0.05 to 0.3 wt. %, of the total composition. The lubricants to which the ester base copolymeric products of this invention can be added include not only hydrocarbon oils derived from petroleum, tar sand or shale but also include synthetic oils of the hydrocarbon polyester variety and mixtures thereof.

The additive may be conveniently dispensed as a concentrate comprising 20–98 parts by weight, preferred about 50 parts by weight of the additive dissolved in from 2 to 80 parts by weight of a mineral lubricating oil with or without other additives being present.

The invention can be more fully understood by reference to the following examples:

EXAMPLE 1

Copolymer of $C_{18}$ 1-olefin and maleic anhydride

The laboratory preparation of this maleic anhydride-1-olefin copolymer was as follows:

To a 2000 ml. 4-necked flask having a stirrer, thermometer, and charging funnel were added: 200 ml. of toluene, 670 ml. of a $C_{18}$ 1-olefin and 10.5 ml. of t-butyl perbenzoate. The solution was heated to about 120° C. and at this temperature a solution of 172 grams of maleic anhydride in 500 ml. of toluene was added over a period of 4 hours and held for a further 2 hours. The reaction mixture was cooled to ambient temperature and the copolymer isolated by removal of volatile components. The copolymer yield was about 89%.

EXAMPLE 2

Copolymer of di-($C_{32}$ to $C_{36}$ 2-alkyl)fumarate and vinyl acetate

A 500 ml. flask was used for preparing the di-($C_{32}$ to $C_{36}$ alkyl)fumarate wherein 5.2 (0.034 mol) fumaroyl chloride dissolved in 25 ml. of toluene was added over a 3 hour period to a mixture of 21 g (0.04 mol) of Standamul GT3236 [a mixture of 2-alkyl alkanols ($C_{32}$, $C_{34}$, $C_{36}$) Branch-Chain Alcohols wherein said alkyl portions are linear and contain 14 and 16 carbon atoms and the alkanol portions are also linear and contain 18 and 20 carbon atoms, sold by Henkel, Inc. Hoboken, N.J. 07030], 30 ml. of triethylamine and 300 ml. of toluene. After the addition was completed, the reactants were heated to 65° C. and held for 16 hours. The system was then cooled to room temperature and the ester precipitated by adding 1500 ml. of methanol and 83 ml. of HCl. The crude product was recrystallized in methanol and analyzed for 79.8 wt. % C, 12.8 wt. % H, had a ($\overline{M}_n$) of 939 as measured by Vapor Phase Osmometry (VPO) and gave a yield of 63% of theoretical.

5.0 gr. (0.003 mol) of the $C_{32}$–$C_{36}$ branched dialkyl fumarate prepared as above was reacted with 0.4 ml. (0.0004 mol) of vinyl acetate in the presence of 40 mg. of Lucidol 70, a 70% active benzoyl peroxide aqueous solution sold by Wallace and Tiernan of Buffalo, N.Y., in 8 ml. of hexane at about 70° C. for 16 hours. The copolymer was isolated by dialysis with a yield of 22.5%.

EXAMPLE 3

Copolymer of di-($C_{24}$ to $C_{26}$ 2-alkyl)fumarate and vinyl acetate

The procedure of Example 2 was followed except that Standamul GT3236 was replaced with Standamul 2428 [a mixture of 2-alkyl alkanols ($C_{24}$, $C_{26}$, $C_{28}$) Branch-Chain Alcohols wherein said alkyl portions are linear and contain 10 and 12 carbon atoms and said alkanol portions are linear and contain 14 and 16 carbon atoms, sold by Henkel, Inc.]

The yield of di-($C_{24}$ to $C_{26}$ 2-alkyl)fumarate was 50% and analyzed for 80.2 wt. % C, 12.8 wt. % H and had a ($\overline{M}_n$) of 901 (VPO).

The yield of copolymer was 36%.

EXAMPLE 4

2-($C_{24}$–$C_{28}$)alkyl ester of a copolymer of a $C_{18}$ 1-olefin and maleic anhydride 15.5 gr. of the $C_{18}$ 1-olefin maleic anhydride copolymer of Example 1 was reacted with 18.6 gr. of Standamul GT-2428 in 200 ml. of xylene and in the presence of 1 gr. of p-toluene sulfonic acid by heating at 138° C. for 16 hours during which time the water of esterification was removed. The mixture was cooled to room temperature, twice washed with water after which the volatile components were removed with nitrogen. The yield by dialysis was about 50%.

EXAMPLE 5

2-($C_{32}$–$C_{36}$)alkyl ester of a polymer of a $C_{18}$ 1-olefin and maleic anhydride The procedure of Example 4 was followed except that the Standamul GT-2428 was replaced with 25.6 gr. of Standamul GT3236. The yield by dialysis was about 50%.

EXAMPLE 6

2-($C_{24}$ to $C_{36}$)alkyl ester of a copolymer of a $C_{18}$ 1-olefin and maleic anhydride The procedure of Example 4 was followed except that the Standamul GT-2428 was replaced with a mixture of 3.7 gr. of Standamul GT-2428 and 20.5 gr. of Standamul GT-3236.

The yield by dialysis was about 50%.

EXAMPLE 7

2-($C_{32}$ to $C_{36}$)alkyl ester of a copolymer of a $C_{14}$ 1-olefin and maleic anhydride The procedure of Example 4 was followed except that the $C_{18}$ 1-olefin maleic anhydride copolymer was replaced with 6.75 gr. of a $C_{14}$ 1-olefin maleic anhydride copolymer commercially available from Gulf Oil Company, Houston, Tex. as Polyanhydride PA-14 and 25.6 gr. of Standamul GT-3236 was used. The yield by dialysis was about 33%.

Analysis of each esterified copolymer is set forth hereafter in Table I.

TABLE I

| Product of Example | Copolymer | 2-alkyl alcohol $C_{24}$-$C_{28}$ | 2-alkyl alcohol $C_{32}$-$C_{36}$ | $(\overline{M}_n)$ | wt. % C | wt. % H |
|---|---|---|---|---|---|---|
| 2 | dialkyl fumarate vinyl acetate | | | 1900 | 75.6 | 11.5 |
| 3 | dialkyl fumarate vinyl acetate | | | 4900 | 76.5 | 12.4 |
| 4 | $C_{18}$ 1-olefin maleic anhydride | | | 3700 | 79.8 | 12.6 |
| 5 | $C_{18}$ 1-olefin maleic anhydride | | | 3600 | 80.7 | 12.9 |
| 6 | $C_{18}$ 1-olefin maleic anhydride | (0.2 m) | (0.8 m) | 4700 | 80.4 | 12.8 |
| 7 | $C_{14}$ 1-olefin maleic anhydride | | | 5100 | 78.3 | 12.4 |

The various additives according to this invention were evaluated for pour point depressant activity in lubricating oils by testing according to ASTM Test D-97. The test results are hereafter set forth in Table II. In each instance the additive was added to the blend as a solid and dissolved at about 54° C. with stirring.

TABLE II

| Test No. | Product of Example No. | Treat wt. % | POUR POINT °F. OF OIL BLEND SAE GRADE 10W-40(c) | 10W(d) | 10W-30(e) | 10W-40(f) |
|---|---|---|---|---|---|---|
| II-1 | — | — | 0 | 5 | +15 | +5 |
| II-2 | 2 | 0.1 | −10 | −15/−15 | — | — |
| II-3 | 3 | 0.1 | 0 | −20/−25 | — | — |
| II-4 | 4 | 0.1 | −5/+5 | −25/−15 | −5/−15 | −20 |
| II-5 | 4 | 0.3 | −15 | −35 | — | — |
| II-6 | 5 | 0.1 | −15/−15 | −30/−25 | −25/−25 | −20/−20 |
| II-7 | 5 | 0.3 | −30 | −30 | −20 | — |
| II-8 | 6 | 0.1 | −15/−25 | −30/−30 | −15/−15 | −20/−20 |
| II-9 | 6 | 0.3 | −30 | −30 | −20 | — |
| II-10 | 7 | 0.1 | — | −20/−20 | — | −20/−20 |
| II-11 | 7 | 0.3 | −35 | −35 | −30 | — |

(c)This blend of oils had a $K_{vis}$ @ 99° C. of 16.73 cs and a −18° $C._{vis}$ of 25.5 p as determined by cold crank simulation (ccs).
(d)This blend of oils had a $K_{vis}$ @ 99° C. of 6.51 cs and a −18° $C._{vis}$ of 17.3 p.
(e)This blend of oils had a $K_{vis}$ @ 99° C. of 10.2 cs and a −18° $C._{vis}$ of 23 p.
(f)This blend of oils had a $K_{vis}$ @ 99° C. of 15.84 cs and a −18° $C._{vis}$ of 22.9 p.

The data set forth in Table II shows that the additives of the invention have pour point depressant activity in a wide range of formulated oils including both single and multigrade types.

It is to be understood that the Examples present in the foregoing specification are merely illustrative of this invention and are not intended to limit it in any manner; nor is the invention to be limited by any theory regarding its operability. The scope of the invention is to be determined by the appended claims.

What is claimed is:

1. A lubricating oil composition comprising a major proportion of a mineral lubricating oil and at least a pour point depressing amount, in the range of about 0.05 to 0.3 weight %, based on the total weight of said composition of a pour depressing copolymer having a number average molecular weight ranging from 1500 to 40,000, wherein said copolymer is a copolymer of $C_{14}$ to $C_{18}$ 1-olefin and maleic anhydride esterified with 1.2 to 2.0 moles of $C_{32}$ to $C_{36}$ 2-alkyl alkanol per molar proportion of maleic anhydride moiety, and wherein said alkyl portion contains 14 or 16 carbon atoms and the alkanol portion contains 18 or 20 carbon atoms.

2. A lubricating oil composition according to claim 1, wherein said olefin is a $C_{14}$ 1-olefin.

3. A lubricating oil composition according to claim 1, wherein said olefin is a $C_{18}$ 1-olefin.

* * * * *